US010905268B2

(12) United States Patent
Goodson et al.

(10) Patent No.: US 10,905,268 B2
(45) Date of Patent: Feb. 2, 2021

(54) BEVERAGE COOLER AND HEATER

(71) Applicants: Mark Goodson, Corinth, TX (US); Christian Ross Goodson, Corinth, TX (US)

(72) Inventors: Mark Goodson, Corinth, TX (US); Christian Ross Goodson, Corinth, TX (US)

( * ) Notice: Subject to any disclaimer, the term of this patent is extended or adjusted under 35 U.S.C. 154(b) by 303 days.

(21) Appl. No.: 15/887,752

(22) Filed: Feb. 2, 2018

(65) Prior Publication Data

US 2018/0153327 A1 Jun. 7, 2018

Related U.S. Application Data

(63) Continuation-in-part of application No. 15/218,442, filed on Jul. 25, 2016, now Pat. No. 10,667,637.

(60) Provisional application No. 62/282,165, filed on Jul. 28, 2015.

(51) Int. Cl.

| | |
|---|---|
| ***A47G 23/03*** | (2006.01) |
| ***F25B 21/04*** | (2006.01) |
| ***F25D 31/00*** | (2006.01) |

(52) U.S. Cl.

CPC ..... *A47G 23/0313* (2013.01); *F25B 21/04* (2013.01); *F25D 31/005* (2013.01); *F25D 31/006* (2013.01); *F25D 31/007* (2013.01); *F25B 2321/0212* (2013.01); *F25B 2700/2104* (2013.01); *F25D 2400/40* (2013.01)

(58) Field of Classification Search

USPC ..... 219/600

See application file for complete search history.

(56) References Cited

U.S. PATENT DOCUMENTS

| | | | | |
|---|---|---|---|---|
| 3,796,850 | A * | 3/1974 | Moreland, II | F24C 15/105 219/622 |
| 4,523,083 | A * | 6/1985 | Hamilton | A47J 36/2461 206/818 |
| 7,687,941 | B2 * | 3/2010 | Raghuprasad | H02J 7/025 307/151 |
| 2011/0220634 | A1 * | 9/2011 | Yeh | A43B 3/0005 219/482 |
| 2014/0054010 | A1 * | 2/2014 | Peters | F25D 31/002 165/104.11 |
| 2014/0251982 | A1 * | 9/2014 | Emma | H05B 6/68 219/679 |
| 2014/0305927 | A1 * | 10/2014 | Alexander | A47J 41/0044 219/387 |

* cited by examiner

*Primary Examiner* — Ibrahime A Abraham
*Assistant Examiner* — Elizabeth M Sims
(74) *Attorney, Agent, or Firm* — Gunn, Lee & Cave, PC

(57) ABSTRACT

A system having a beverage coaster with a receiving coil that can be magnetically coupled or decoupled from a driving coil in a counter, table, bar, and the like. The coaster may be magnetically coupled to the table by moving the coaster into an area where the driving coil generates a magnetic field of sufficient strength. The coaster also includes a switch that activated or deactivated based on its proximity to a magnet in the table. The coaster has a metallic plate on which may be positioned a beverage container. The plate is thermally and mechanically coupled to a Peltier cell that either cools or heats the plate, depending on the state of the switch. A thermostat prevents beverage overheating. A second magnetic switch powers the driving coil only if the coaster is present and aligned with the driving coil.

6 Claims, 4 Drawing Sheets

BEVERAGE COOLER AND HEATER

CROSS REFERENCE TO RELATED APPLICATIONS

This application claims the benefit of and priority to U.S. non-provisional application Ser. No. 15/218,442, filed Jul. 25, 2015, entitled "Beverage Cooler and Heater" which claimed benefit to U.S. provisional application Ser. No. 62/282,165, filed Jul. 28, 2015, entitled "Serving Table With Inset Beverage Cooling." Both applications are incorporated by reference.

STATEMENT REGARDING FEDERALLY SPONSORED RESEARCH OR DEVELOPMENT

Not Applicable

BACKGROUND OF THE INVENTION

1. Field of the Invention

The present invention generally applies to temperature control of a liquid. More specifically, the present invention relates to temperature heating and cooling of an already served beverage.

2. Description of the Related Art

Drinks that are served in a restaurant are usually cooled or heated, with many beverages being cooled by ice. Some drinks, such as coffee and cocoa, are enjoyed while being served hot or warm. The laws of heat transfer mandate that over time thermal gain or loss of the beverage will continue until the beverage reaches room temperature (thermal equilibria). Drinks that are cold will usually have ice melt due to heat gain, while drinks served warm or hot will have a heat loss and thus they cool off.

Some issued patents make use of heating and cooling of a glass, cup or similar vessel. Senecal (U.S. Pat. No. 5,718,124), for example, teaches the refrigeration of a service bowl, with the refrigeration circuitry being part of the bowl. Similarly, Alexander (U.S. Pat. Nos. 8,759,721 and 9,035,222) teach the use of heated or cooled beverage holders where the circuitry that is providing the temperature change is part of the glassware or serving dishes. Simcray (U.S. Pat. No. 6,279,470) teaches the use of vessel that has an armature as part of the plate or food holder. Simcray, however, does not teach the use of a coaster that can accommodate various cooking vessels that may already be owned by the user.

Additional publications, such as U.S. Pat. Publication 2010/0072191 and Japanese Application 2007-064557, teach harnessing magnetic energy from an induction cooktop or stove for cooling purposes only. In these publications, the magnetic coils have differing sizes causing the energy transfer to be inefficient. Furthermore, the large transmitting area of a magnetic field that is on a cooktop results magnetic flux that is not intercepted by the receiving coil. This excess flux can generate eddy currents in nearby ferrous parts, causing overheating. The Japanese Application 2007-064557 discloses its own container or vessel, which offers less utility than a coaster which can be used with multiple vessels. Finally, none of these publications teach or suggest a presence sensor which only allows powering of the transmitting coils if a receiving coil is present.

BRIEF SUMMARY OF THE INVENTION

The present invention provides a number of advantages over existing art. For example, the present invention allows the cooling of a beverage holder (e.g., a cup or glass) without the necessity of that beverage holder containing any circuitry or specially designed components. Moreover, the present invention allows heating or cooling of the beverage holder to be selected without the use of any manually operated switch; instead, a change of alignment of the coaster will allow the cooling or heating mode to turned off or put the coaster into the desired mode. The present invention also provides a presence indicator switch that prevents an energized table surface if the heating or cooling of the coaster is not needed at a particular moment.

Structurally, the present invention comprises a beverage coaster having a first end, an opposing second end, a housing, a non-corrosive metallic plate connected to the housing at the first end, a Peltier cell within the housing mechanically and thermally connected to the metallic plate, a switch within the housing, a receiving coil located within the housing proximal to the second end, and coaster circuitry electrically connected to the Peltier cell, the switch, and the receiving coil; and a counter or table with a top surface and a bottom surface, a magnet, a driving coil, and driver circuitry connected to the driving coil. A second magnetic switch is placed in series with the power supply of the table-embedded driving coil, and a corresponding magnet is mounted in the coaster and allows the transmitting coil to be powered when the coaster is present.

DESCRIPTION OF SPECIFIC EMBODIMENTS

Figure 1:
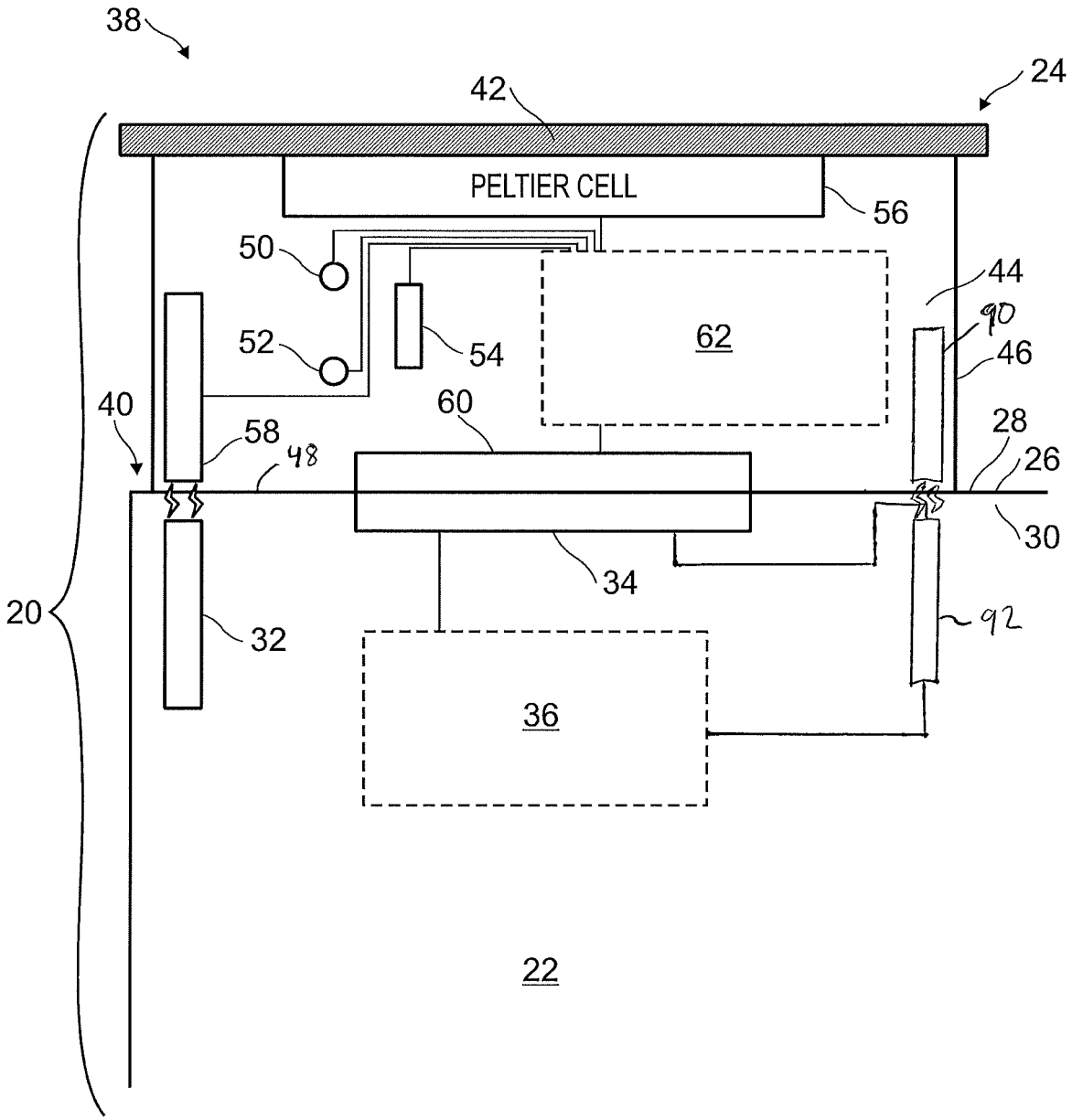
FIG. 1 shows an embodiment of the present invention.

FIG. 1 shows an embodiment 20 of the invention, which includes a counter 22 and a beverage coaster 24. The counter 22 includes a countertop 26 with a top surface 28 and a bottom surface 30, a rod magnet 32, an inductive driving coil 34, and driver circuitry 36 electrically connected to the inductive driving coil 34. A reed switch 92 is placed in series between the driver circuitry 36 and the inductive driving coil 34. The rod magnet 32, inductive driving coil 34, reed switch 92 and driver circuitry 36 are adjacent to the bottom surface 30 of the countertop 26. While this embodiment 20 contemplates the inductive driving coil 34 and driver circuitry 36 being adjacent the countertop, alternatively, they can be inset as part of the countertop 26. Although this embodiment 20 is described specifically with reference to a countertop, other embodiments contemplate the invention include a table, bar top, and the like.

The coaster 24 is generally a closed cylinder with a first end 38 and a second end 40. The second end 40 contacts the countertop 26 opposite the driver circuitry 36. The coaster 24 is made of a solid cylindrical copper plate 42 attached to a hollow cylindrical plastic housing 44 with a sidewall 46 and a closed end 48 coterminal with the second end 40. A red LED 50, a blue LED 52, and a USB port 54 are mounted to the sidewall 46. Copper is preferred because of its resistance to corrosion and for its coefficient of thermal conductivity, but other metals may be used. A rod magnet 90 is located at the second end of closed end 48.

The housing 44 encloses a Peltier cell 56 (sometimes called a Peltier device, Peltier heat pump, solid state refrigerator, or thermoelectric cooler (TEC)), a reed switch 58, a receiving coil 60, and coaster circuitry 62. The Peltier cell 56 is mechanically and thermally connected to the copper plate 42. The thermal connection is enhanced with the use of thermally conducting grease (not shown) between the Peltier cell 56 and the copper plate 42. The reed switch 58 is adjacent to the sidewall 46 of the housing 44 and is aligned with, and magnetically coupled to, the magnet 32. The receiving coil 60 is located proximal to the closed end 48 and is vertically aligned with the driving coil 34. The coaster circuitry 62 electrically connects the LEDs 50, 52, the USB port 54, the Peltier cell 56, and the reed switch 58. The reed switch 92 is adjacent to the sidewall 46 of the housing 44 and is aligned with, and magnetically coupled to, the magnet 90. An optional thermostat 96, having a sensor 102, is electrically in series with the power lead to the Peltier cell 56. The sensor 102 is mounted to copper plate 42. In the preferred embodiment the sensor 102 and thermostat 96 may be mechanical, or bimetal, switch.

Figure 2:
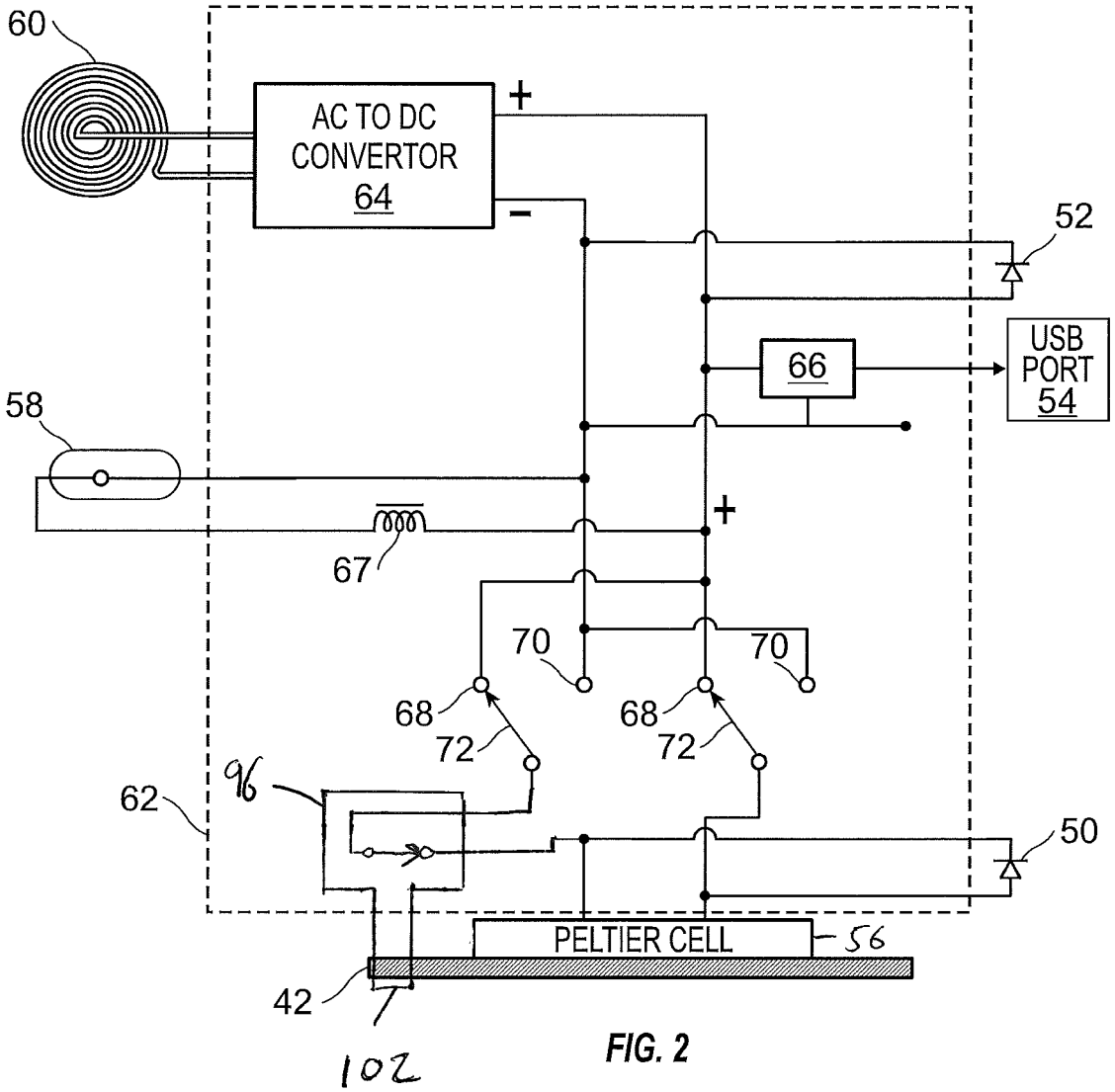
FIG. 2 is a schematic of the coaster circuitry of the embodiment in a "heating" configuration.

Referring to FIG. 2, the coaster circuitry 62 includes an AC-to-DC converter 64 connected to the receiving coil 60, a voltage regulator 66 connected to the USB port 54, a relay coil 67 connected to the reed switch 58, a first pair of relay contacts 68, a second set of relay contacts 70, and a pair of relay armatures 72. The regulator 66 is a standard 3-lead 5-volt regulator that provides power to the USB port 54, allowing the coaster 24 to also serve as a means for charging a phone or operating a game. The thermostat 96 allows current to the Peltier cell to be temporarily be removed should a desirable drink temperature be reached. In a preferred embodiment, the inductive driving coil 34 and the receiving coil 60 are tuned to the same frequency to maximize efficiency. In a further preferred embodiment, the inductive driving coil 34 and the receiving coil 60 have approximately the same diameter. In a preferred embodiment, the inductive driving coil 34 and the receiving coil 60 have a diameter of approximately two inches.

In FIG. 2, the reed switch 58 and armatures 72 are in the state corresponding to the position of the coaster 24 shown in FIG. 1, with the reed switch 58 aligned with the magnet 32. The reed switch 58 is closed and the armatures 72 are in contact with the first pair of contacts 68. This configuration causes the Peltier cell 56 to generate heat at the connection with the copper plate 42. The red LED 50 is in parallel with the input of the Peltier cell 56 and will be energized in this configuration when the receiving coil 60 is energized and the reed switch 58 is closed. The blue LED 52 is energized whenever the receiving coil is energized, regardless of the state of the reed switch 58.

Figure 3:
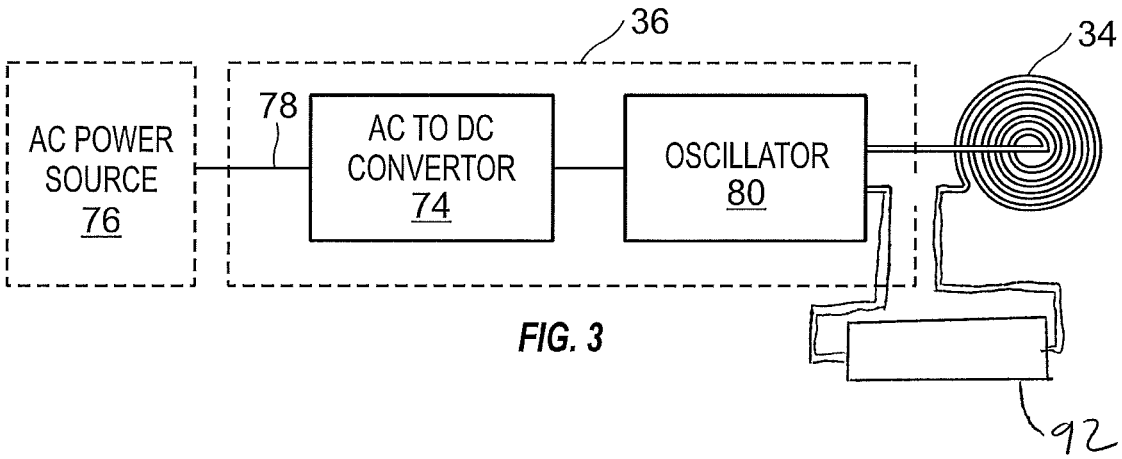
FIG. 3 is a schematic of the driver circuitry of the embodiment.

Referring to FIG. 3, the driver circuitry 36 includes an AC-to-DC converter 74 connectable to an AC input source 76 (nominal 120 VAC 60 Hz) with a line cord 78. The converter 74 rectifies and filters the signal from the input source 76. The output of the converter 74 is connected to a 10 KHz oscillator 80 that generates a square wave. The output of the oscillator 80 is connected to the driving coil 34 and passes through reed switch 92. The reed switch 92 must be closed in order for the driving coil 34 to be energized. When a coaster is not in use for cooling or heating, the coaster is rotated or moved in such a manner that the magnet 90 is not positioned over the reed switch 92. The driver circuitry 36 is enclosed so it is protected from mechanical damage (e.g., spills, mechanical cuts from serving utensils).

Figure 4:
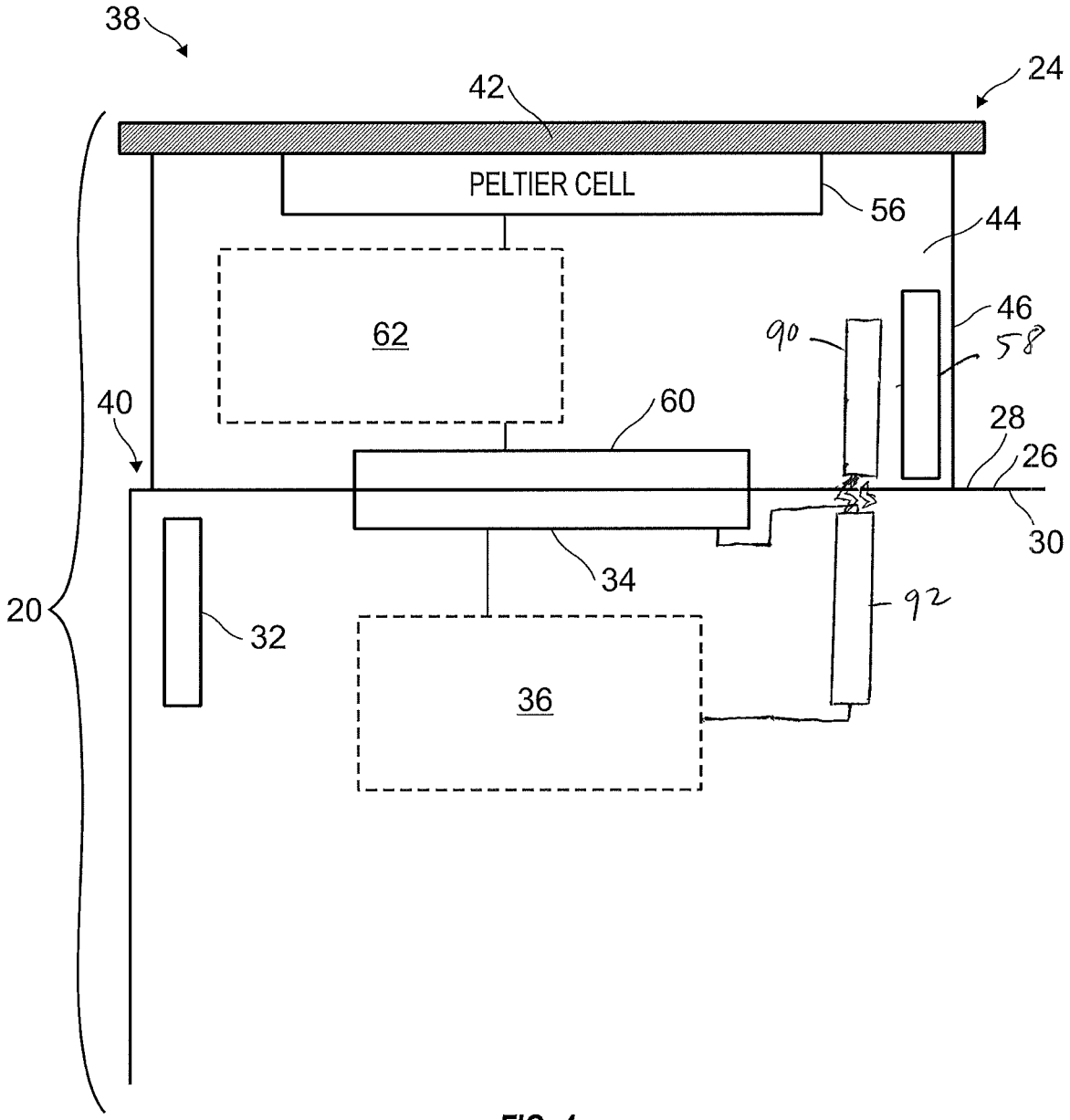
FIG. 4 shows the reed switch of the coaster misaligned with the magnet of the countertop.

Referring to FIG. 4, the coaster 24 is rotated relative to its position in FIG. 1 so the reed switch 58 is not aligned with the rod magnet 32. However, the reed switch 92 remains aligned with the magnet 90.

Figure 5:
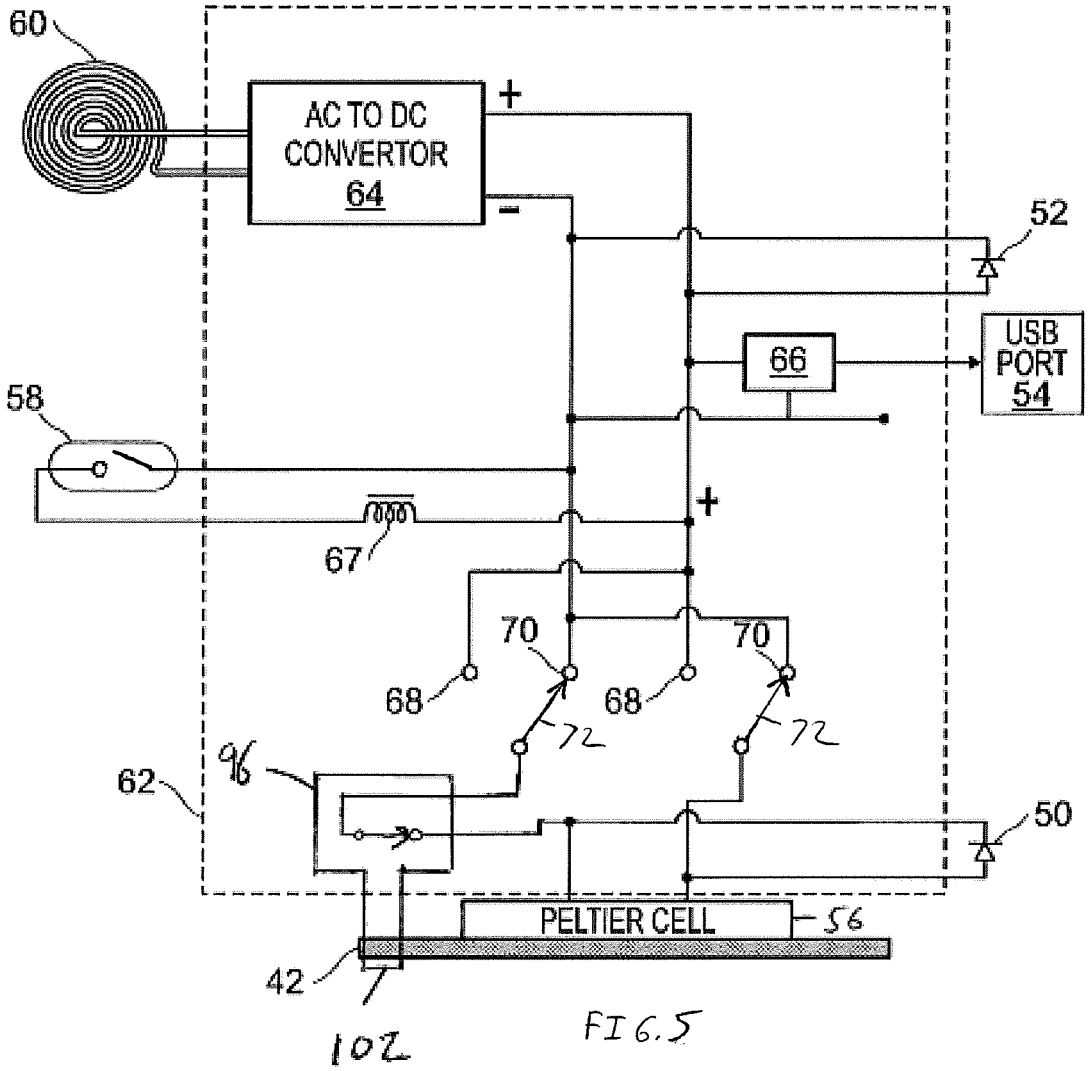
FIG. 5 is a schematic of the coaster circuitry of the embodiment in a "cooling" configuration.

Referring to FIG. 5, corresponding to the position of the coaster 24 shown in FIG. 4, when the reed switch 58 is not aligned with the magnet 32, the reed switch 58 is open. This causes the armatures 72 to be in their normal position of contact with the second set of contacts 70. This configuration causes the Peltier cell 56 to cool at its connection with the copper plate 42. Only the blue LED 52 is energized in this configuration, indicating magnetic coupling (and resultant energy transfer) between the driving coil 34 (see FIG. 3) and the receiving coil 60 in the coaster 24.

In order to provide heating to the copper plate, the coaster 42 must be positioned in such a manner that the magnet 90 and the reed switch 58 of the coaster 42 are aligned with the reed switch 92 and the magnet 32 of the counter 22. In order to provide cooling to the copper plate, the coaster 42 must be positioned in such a manner that the magnet 90 of the coaster 42 is aligned with the reed switch 92 but positioned in such a manner that the reed switch 58 is not aligned with the magnet 32 of the counter 22. To ensure the surface of the counter 22 is not energized, i.e. the driving coil 34, the magnet 90 of the coaster 42 should not be aligned with the reed switch 92 of the counter 22. If the desired temperature is reached as sensed by the thermostat 96, the circuit is opened and prevents further current from flowing into the Peltier cell 56.

While the present invention describes an invention used for cooling and heating, there are some restaurants (coffee shops) that will require only heating. It is recognized that the Peltier cell can be removed and replaced with a resistance heater in the form of a resistor, or a coil of small diameter resistance wire that would partially encase the beverage vessel, without deviating from the scope of this invention. In this embodiment the copper plate, or other suitable material with a good coefficient of thermal conductivity energy conductive, may have a sidewall that encases a portion of the beverage vessel.

The present invention is described in terms of a specifically described embodiment. Those skilled in the art will recognize that other embodiments of such method and system can be used in carrying out the present invention. Other aspects and advantages of the present invention may be obtained from a study of this disclosure and the drawings, along with the appended claims.

We claim:

1. A beverage heating and cooling-system comprising:

a beverage coaster having a first end, an opposing second end, a housing, a metallic plate connected to the housing at the first end, a Peltier cell within the housing mechanically and thermally connected to the metallic plate, a first switch within the housing having a first position that results in cooling the metallic plate and a second position and that results in heating the metallic plate, a receiving coil located within the housing proximal to the second end, and coaster circuitry electrically connected to the Peltier cell, the switch, and the receiving coil; and a counter with a countertop having a top surface and a bottom surface, a magnet, a power source, a driving coil magnetically coupled with the receiving coil, a second switch within the countertop having a first position and a second position wherein the power source supplies power to the driving coil when the second switch is in the first position, and driver circuitry connected to the driving coil;

wherein the position of the beverage coaster in relation to the counter determines whether the first switch is in the first position or second position and whether the second switch is in the first position or second position.

2. The system of claim 1 where the driving coil is the same size in diameter as the receiving coil.

3. The system of claim 1 further comprising a USB port mounted to the housing and electrically connected to the coaster circuitry.

4. The system of claim 1 wherein the power source is an AC-to-DC converter.

5. The system of claim 1 further comprising a thermostat in series with the Peltier cell and a sensor connected to the metallic plate wherein the sensor is in communication with the thermostat.

6. The system of claim 5 wherein the thermostat stops current flowing to the peltier cell when the sensor reaches a set temperature.

* * * * *